US007278286B2

(12) United States Patent
Taniguchi et al.

(10) Patent No.: US 7,278,286 B2
(45) Date of Patent: Oct. 9, 2007

(54) ROLLING DIE AND A METHOD OF MAKING A ROD WITH A BALL PORTION

(75) Inventors: Naoshige Taniguchi, Kasugai (JP); Yoshio Nonaka, Kasugai (JP); Norishige Hayashi, Aichi (JP); Kazuhiko Masuo, Kasugai (JP)

(73) Assignee: Kabushikikaisha Sanmei Seisakusho, Kasugai-shi (JP)

( * ) Notice: Subject to any disclaimer, the term of this patent is extended or adjusted under 35 U.S.C. 154(b) by 0 days.

(21) Appl. No.: 11/491,977

(22) Filed: Jul. 25, 2006

(65) Prior Publication Data

US 2007/0022795 A1 Feb. 1, 2007

(30) Foreign Application Priority Data

Jul. 26, 2005 (JP) ..... 2005-215275

(51) Int. Cl.
*B21H 1/00* (2006.01)

(52) U.S. Cl. ..... 72/88; 72/469; 29/557

(58) Field of Classification Search ..... 72/88, 72/89, 90, 469; 29/557, 558
See application file for complete search history.

(56) References Cited

U.S. PATENT DOCUMENTS 385,186 A * 6/1888 Kempster ..... 72/89
3,186,204 A * 6/1965 Kikuchi ..... 72/89
2005/0217345 A1* 10/2005 Taniguchi et al. ..... 72/469

FOREIGN PATENT DOCUMENTS

| | | | |
|---|---|---|---|
| DE | 1916832 | A * | 11/1970 |
| DE | 4319076 | A1 | 12/1993 |
| DE | 19955768 | A1 | 3/2001 |
| GB | 1317148 | | 5/1973 |
| GB | 1387650 | | 3/1975 |
| JP | 9-206867 | | 8/1997 |
| JP | 2002-130248 | | 5/2002 |
| JP | 2004-66246 | | 3/2004 |
| WO | WO 2005051594 | A2 | 6/2005 |

* cited by examiner

*Primary Examiner*—Dmitry Suhol
(74) *Attorney, Agent, or Firm*—Finnegan, Henderson, Farabow, Garrett & Dunner, LLP

(57) ABSTRACT

A rolling die is provided for forming a rod member with a ball portion. The rolling die includes a first die member and a second die member facing the first die member. Each of the first die member and the second die member has a process surface. The process surface has a start forming portion having a process tooth configured to bite the rod member and an arc surface portion proximate the process tooth, an intermediate forming portion having the process tooth and a curved surface proximate the process tooth, the curved surfaced being configured to press the rod member to form an arched shape, and a finish forming portion having the process tooth and a hemispheric groove configured to press the rod member into the arched shape to form the ball portion.

3 Claims, 7 Drawing Sheets

ROLLING DIE AND A METHOD OF MAKING A ROD WITH A BALL PORTION

CROSS REFERENCE TO RELATED APPLICATION

This application is based upon and claims the benefit of priority from Japanese Patent Application No. 2005-215275, filed on Jul. 26, 2005, the entire content of which is incorporated herein by reference.

FIELD OF THE INVENTION

The present invention relates to a rolling die. More particularly, the invention relates to a rolling die for making a rod with a ball portion, such as a ball joint, and a method of making such a rod.

BACKGROUND

In general, a rod-like workpiece having a ball portion at one end, such as a ball joint, is manufactured by a cutting and grinding process. As shown in FIG. 12, a rod member 50 has a narrow diameter portion 51, a flange with a hexagonal cross-section 52, and a cylindrical tip portion 53. The rod member is held at the narrow diameter portion 51 by a chuck of a numerically controlled (NC) machine (not shown in the figure). Then, as shown in FIG. 13, a sloped surface 54 and an arched surface 55 are formed by a cutting and grinding process when a cutting point of a bite (not shown in the figure) radially approaches the cylindrical tip portion 53 near the flange 53 and the bite is moved axially as it changes its radial position with respect to the cylindrical tip portion.

By moving the bite radially and axially towards the tip of the cylindrical tip portion 53, a hemisphere 56 is formed at the tip of the cylindrical tip portion 53 by a cutting and grinding process as illustrated in FIG. 14. As a result, a ball joint 58 is formed at the end of the rod member. Alternatively, in this cutting and grinding process using an NC machine, the ball joint 58 can be formed by cutting and grinding the sloped surface 54 and the arched surface 55 after the hemisphere 56 is formed.

It is possible to form a ball portion 57 having desired shape and size by the cutting and grinding process for making the ball joint 58 described above. However, the hemisphere 56 and the arched surface 57 of the ball portion 57 need to be polished to increase surface roughness by a rolling round die having a varnished surface that has an arced cross-sectional shape and is coated with a super-hard alloy layer. Performing this process for each ball joint increases manufacturing time and cost. Moreover, a lot of scrapes are produced from the cutting and grinding process, and a complicated program is required for setting values for controlling the NC machine.

Therefore, the present invention is directed to address one or more of the above problems and to provide a rolling die that is capable of making a rod with a ball portion in a time and cost effective manner and with high precision and a method for making such a rod.

SUMMARY OF THE INVENTION

A rolling die is provided for forming a rod member with a ball portion. The rolling die includes a first die member and a second die member facing the first die member. Each of the first die member and the second die member has a process surface. The process surface has a start forming portion having a process tooth configured to bite the rod member and an arc surface portion proximate the process tooth, an intermediate forming portion having the process tooth and a curved surface proximate the process tooth, the curved surfaced being configured to press the rod member to form an arched shape, and a finish forming portion having the process tooth and a hemispheric groove configured to press the rod member into the arched shape to form the ball portion.

Also, a method of making a rod member with a ball portion is provided. The rod member has a cylindrical portion. The method includes placing the cylindrical portion of the rod member between a first process surface of a first die member and a second process surface of a second die member, each of the first and second process surfaces including a finish forming portion having a hemispheric groove, rolling the cylindrical portion between the first process surface and the second process surface, pressing the cylindrical portion in axial and radial directions thereof by the hemispheric groove formed on each of the first process surface and the second process surface, and forming the ball portion at an end of the rod member as the rod member is moved in a longitudinal direction of the first and second die members.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Figure 1:
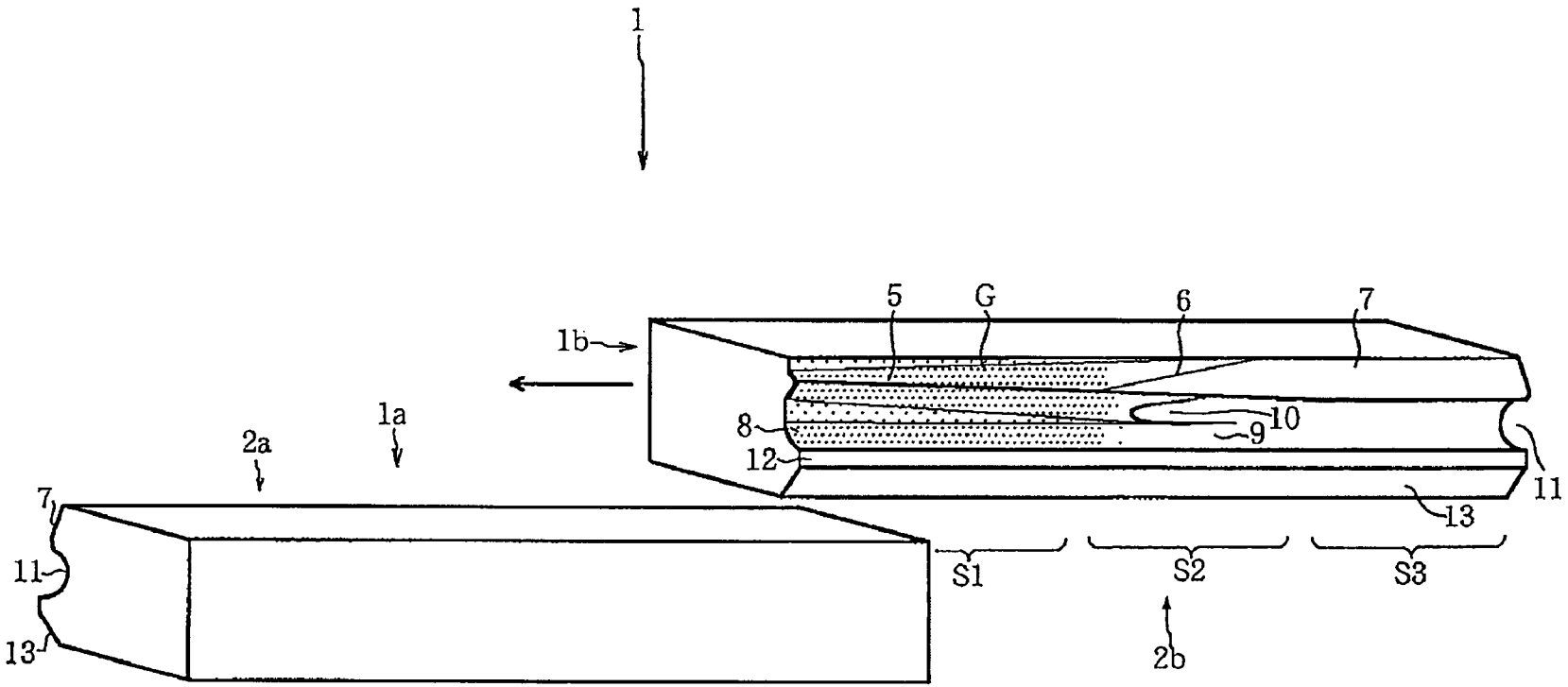
FIG. 1 is a perspective view of a rolling die according to one exemplary embodiment of the present invention.

Reference will now be made in detail to exemplary embodiments of the invention, examples of which are illustrated in the accompanying drawings. Wherever possible, the same reference numbers will be used throughout the drawings to refer to the same or like parts.

A rolling die according to one embodiment of the invention includes a first die member and a second die member faced with the first die member. Each of the first die member and the second die member has a process surface. The process surface has a start forming portion having a process tooth configured to bite a rod member and an arc surface portion proximate the process tooth, an intermediate forming portion having the process tooth and a curved surface proximate the process tooth, the curved surface being configured to press the rod member to form an arched shape, and a finish forming portion having the process tooth and a hemispheric groove configured to press the rod member into the arched shape to form a ball portion.

In this regard, as an elongated member, such as a rod, is held and rolled between a pair of die members, a pair of process teeth facing each other gradually bite into the rod, and an arc surface, a curved surface, and a hemispheric groove disposed proximate the process teeth press the rod member in the axial and radial directions. As a result, an approximately round ball portion can be formed by a rolling process precisely and quickly, for example within about one second to several seconds. Also, it is possible to continuously manufacture ball portions at low cost.

The ball portion in this specification may refer to a single spherical ball, multiple spherical balls formed in the axial direction, a ball having an elliptical or spindle-shaped cross-section, or any suitable ball portion apparent to those skilled in the art from consideration of the specification. Also, the elongated member may be a rod having a ball joint, a handle portion, or a wide-diameter portion at an end or a middle section. Moreover, the die members may include a fixed die member and a movable die member, or a pair of die members movable with respect to each other in an opposite direction. Relatively movable die members include any of the above types or others apparent to one skilled in the art. In one embodiment, furthermore, the process tooth of the die members may be formed gradually toward the center of the die member in the lateral direction of the die member from the start forming portion and the intermediate forming portion. Also, from the intermediate forming portion to the finish forming portion, a process tooth having a different shape may be formed continuing to the process tooth. In addition, the curved surface in the intermediate forming portion may continually form into the hemispheric groove in the finish forming portion. The rolling die having a pair of the die members may be driven by any known slide mechanism, such as a crank mechanism or a pinion and rack mechanism.

According to one embodiment, the process tooth, the arc surface, and the curved surface in the process surface of the die members may be provided with fine dimples. In this regard, the rod member is roughly formed by high friction at the start of the process, and at the finish of the process, the ball portion is formed and its surface is smoothened by a surface finishing process. The dimples may be formed by, for example, shot blasting.

According to one embodiment, a method of making a rod member with a ball portion is provided. The rod member has a cylindrical portion. The method includes placing the cylindrical portion of the rod member between a first process surface of a first die member and a second process surface of a second die member, each of the first and second process surfaces including a finish forming portion having a hemispheric groove, rolling the cylindrical portion between the first process surface and the second process surface, pressing the cylindrical portion in axial and radial directions thereof by the hemispheric groove formed on each of the first process surface and the second process surface, and forming the ball portion at an end of the rod member as the rod member is moved in a longitudinal direction of the first and second die members. By this method, a pair of the process teeth facing each other form a V-shaped groove at the middle of the cylindrical portion, and after forming the arc surface towards the tip of the cylindrical portion, a ball portion is formed by pressing the cylindrical portion in axial and radial directions by the arc surface, the curved surface, and the hemispheric groove. As a result, an approximately round ball portion can be formed by a rolling process precisely and quickly, for example, within about one second to several seconds.

In another embodiment, this method may be applied for a rod member chamfered in preparation for an arched or tapered surface at the tip. In this embodiment, it would be easier to form an arched or tapered surface at the cylindrical portion; however, such a preparatory, chamfered process is not necessary.

Figure 2:
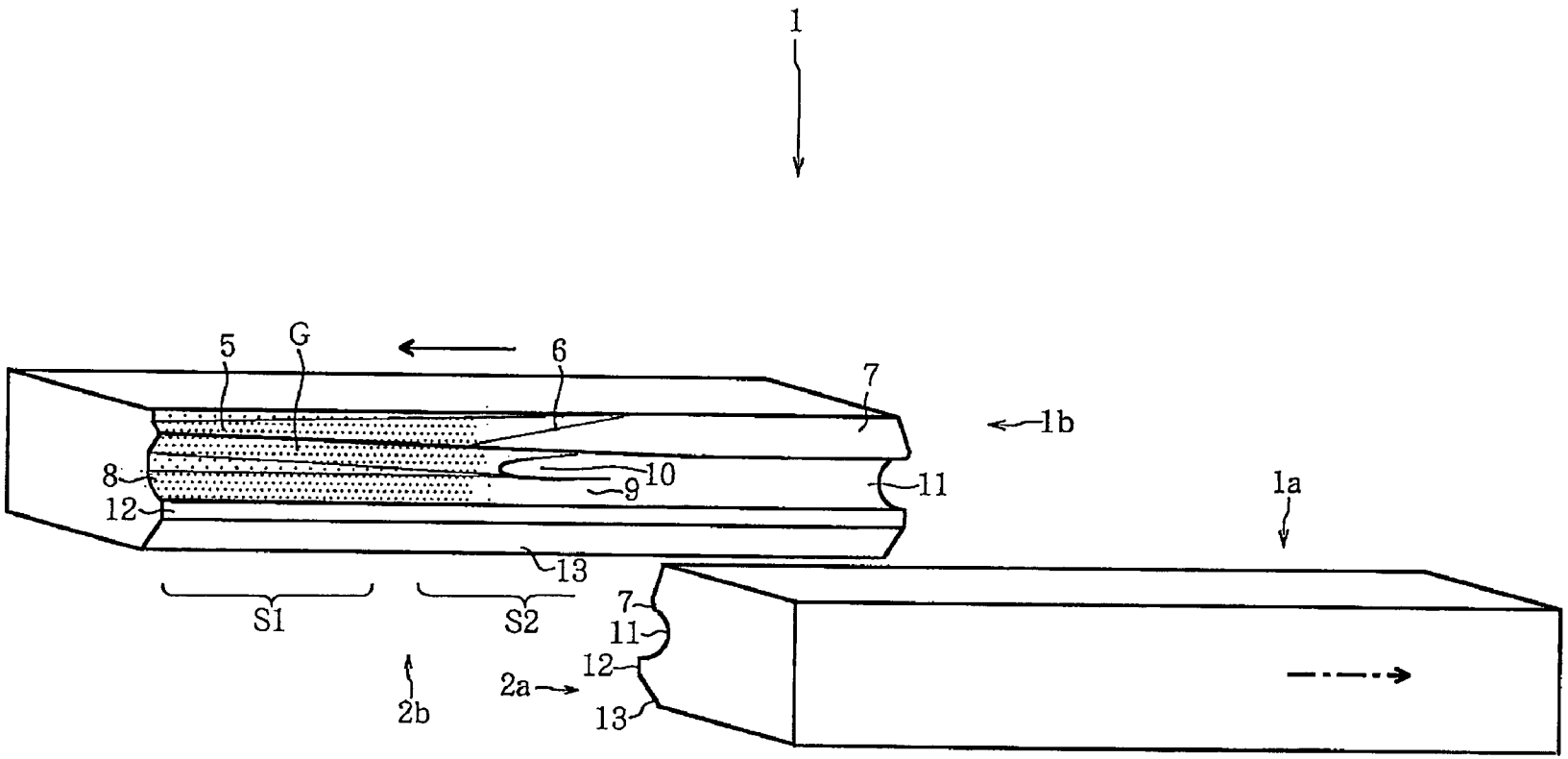
FIG. 2 is another perspective view of the rolling die of FIG. 1.
Figure 3:
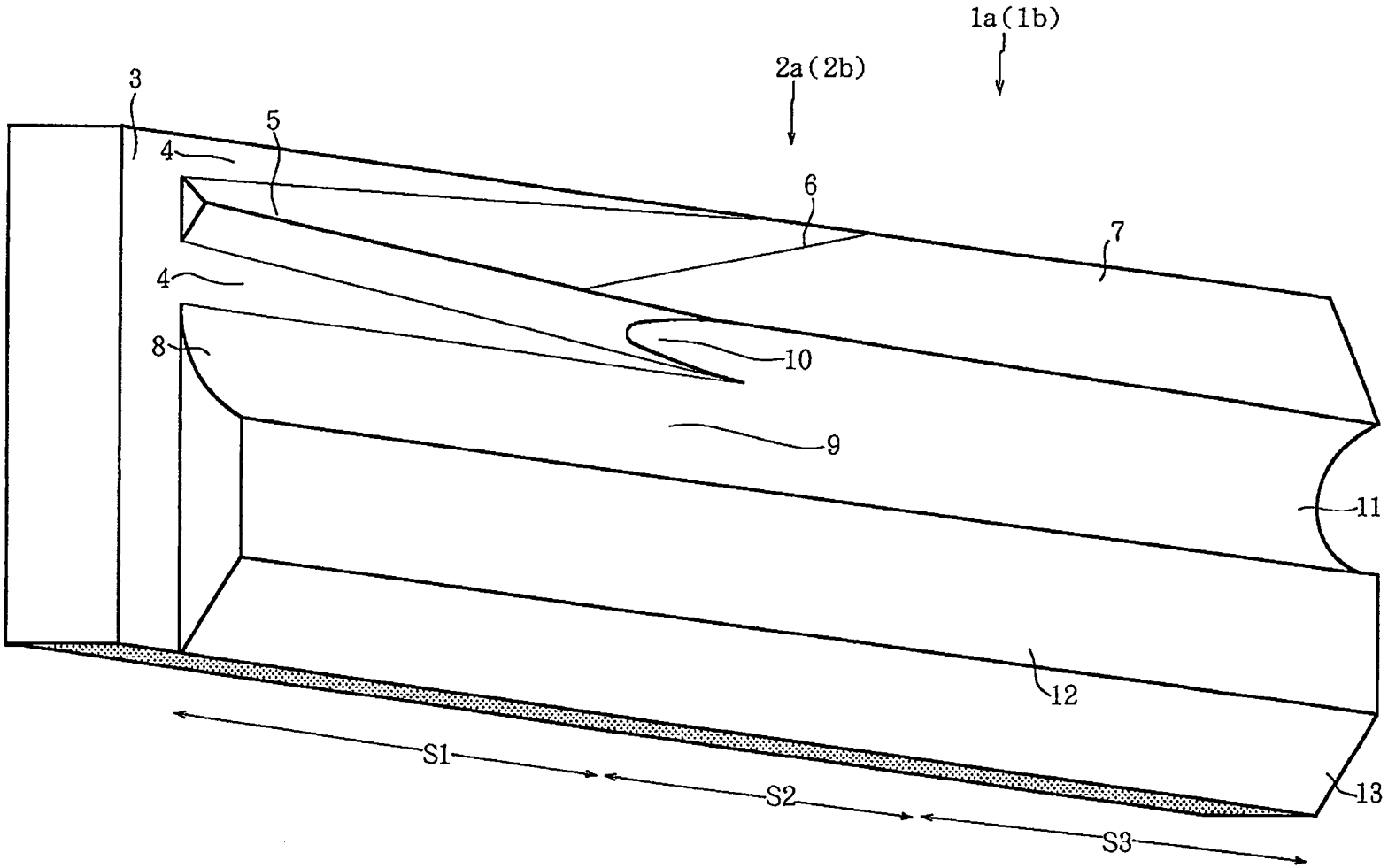
FIG. 3 illustrates a portion of the rolling die of FIG. 1.

FIGS. 1 and 2 are perspective views of a rolling die 1 having a pair of die members 1*a* and 1*b* according to one exemplary embodiment of the present invention, and FIG. 3 are perspective view of process surfaces 2*a* and 2*b* of the die members. To simplify the figures, FIGS. 1 and 2 do not show a flat surface 3 at a start side of the die members 1*a* and 1*b*. The die members 1*a* and 1*b* are typically made of steel, such as SKD11, and have a rectangular shape. Each of the die members has an elongated process surface 2*a* and 2*b* with a symmetric cross-section formed by a grinding and precision process. The process surfaces 2*a* and 2*b* are facing each other. Also, the die member 1*a* may be horizontally fixed to a frame of a rolling die (not shown in the figure), and the die member 1*b* may be supported slidably in the direction of the arrow in FIGS. 1 and 2 and moved by a driving mechanism and a crank mechanism (not shown in the figures). In another embodiment, the die member 1*a* may also be movable in the opposite direction to the die member 1*b* as indicated by the dotted arrow shown in FIG. 2. Thus, the die members 1*a* and 1*b* may be relatively movable with respect to each other.

Figure 4:
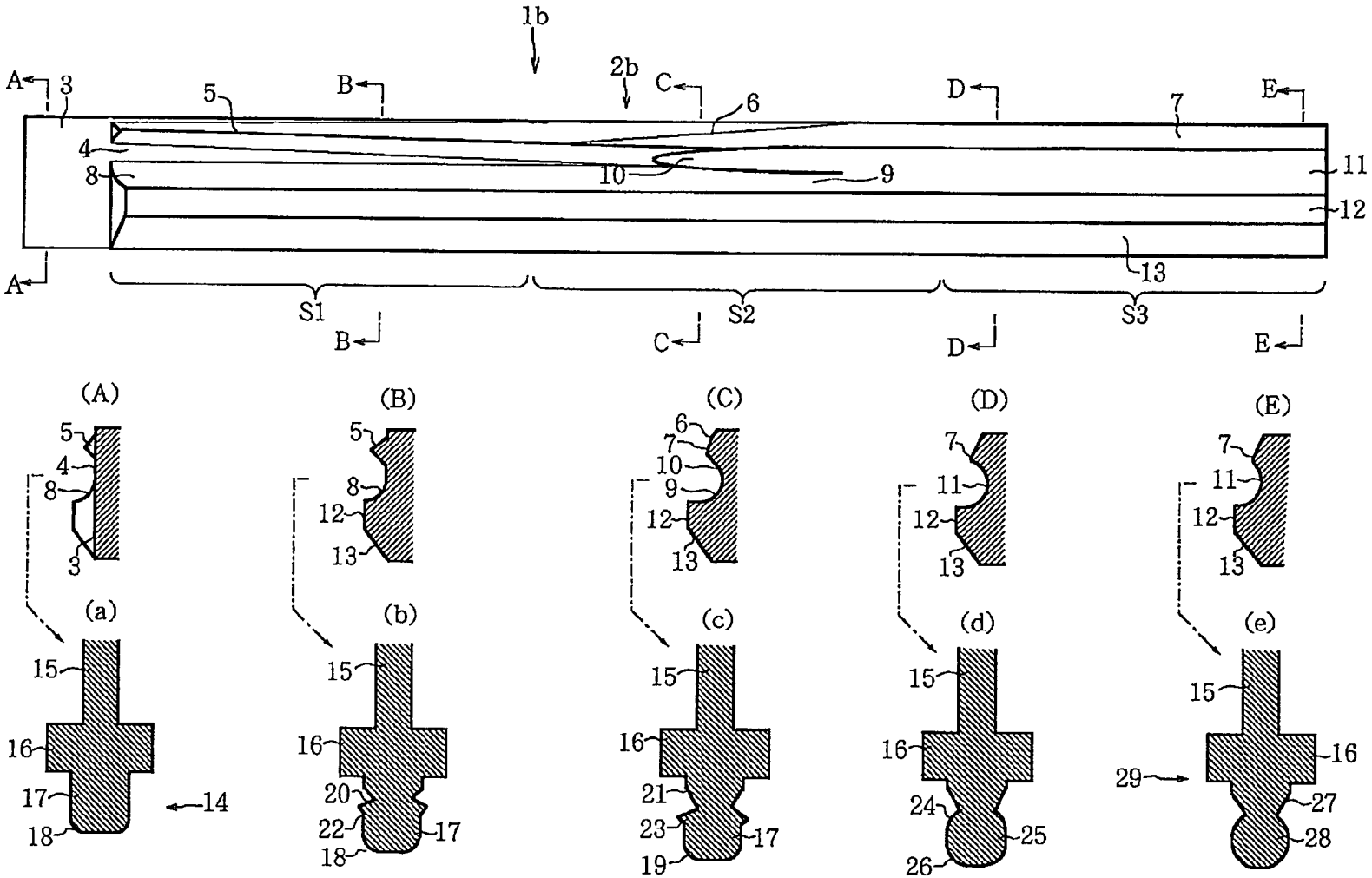
FIG. 4 is a front view of the rolling die of FIG. 1, and (A)-(E) illustrate cross-sections of the corresponding portions of the rolling die of FIG. 4, and (a)-(e) illustrate cross-sections of the corresponding portions of (A)-(E) respectively.

The process surfaces 2*a* and 2*b* of the die members 1*a* and 1*b* are explained in reference to FIGS. 3 and 4. In FIG. 4, (A)-(E) illustrate cross-sections at the corresponding portions indicated by lines A-A, B-B, C-C, D-D, and E-E of the rolling die shown in FIG. 4, and (a)-(e) illustrate cross-sections of the corresponding portions of (A)-(E) respectively. As shown in FIGS. 1-4, the process surface 2*b* of the die member 1*b* includes the flat surface 3 near the side of the die member 1*a* for receiving the rod 3, the start forming portion S1, the intermediate forming portion S2, and the finish forming portion S3. As illustrated in FIGS. 3 and 4(A) and 4(B), the start forming portion S1 includes a process tooth 5 having an inverse V-shaped cross-section, an arc surface 8 having a shallow arc proximate to the process tooth 5, and a perpendicular surface 12 and a sloped surface 13 proximate to the arch surface 8 and extending in the longitudinal direction of the process surface 2*b*. Because the process tooth 5 increases its height and width towards the intermediate forming portion S2, the process tooth 5 is juxtaposed with elongated triangular flat surfaces 4 and 4' connected to the flat surface 3. Also, as shown in FIG. 3, a ridge of the process tooth 5 shifts toward the middle of the process surface 2*b* in the width direction, which is perpendicular to the longitudinal direction, as the ridge extends from the flat surface 3 to the intermediate forming portion S2.

As shown in FIG. 3, the arc surface 8 has a curved surface having a narrower width to the flat surface 4 closer to the flat surface 3, and the flat surface 4 becomes narrower as it is closer towards the intermediate forming portion S2. As shown in FIGS. 1-3 and 4(C), moreover, the intermediate forming portion S2 has a central portion of the process tooth 7 that has a different slope from a ridge 6 that extends from the middle of the ridge of the process tooth 5, a small groove 10 that is disposed proximate to the process tooth 7 and is formed as an extended part of the hemispheric groove which is to be described later, a curved surface 9 that is disposed proximate to the small groove 10 and extends to the arc surface 8, and the perpendicular surface 12, and the sloped surface 13. As shown in FIGS. 1-3 and 4(D) and (E), the finish forming portion S3 has the process tooth 7, the hemispheric groove 11 having an approximately hemispheric cross-section and extending from the arc surface 8, the perpendicular surface 12, and the sloped surface 13.

The surfaces of the arc surface 8, the curved surface 9, and the hemispheric groove 11 extend along the longitudinal direction having the same curved cross-section. Also, fine dimples G may be formed at the start forming portion S1 and a part of the intermediate forming portion S2 proximate to the start forming portion S1. The dimples may be formed by, for example, shot blasting. Furthermore, the process surface 2*a* of the die member 1*a*, which may be a fixed member, has the flat surface 3, the start forming portion S1, the intermediate forming portion S2, and the finish forming portion S3 symmetrical to those of the die member 1*b*. Also, proximate to the finish forming portion S3, a release portion (not shown in the figure) having the same cross-sectional shape to the finish forming portion for a certain length may be provided.

Next, a method of making a rod member with a ball portion by the rolling die 1 is explained according to one embodiment of the invention as illustrated in FIGS. 4-9. FIGS. 5-9 are plane views of the die members 1*a* and 1*b*, which move relatively with respect to each other, and cross-sectional views of the rod member with the ball portion. First, a rod member 14 having the cross-sectional shape shown in FIGS. 4(*a*) and 5 is provided. The rod member 14 may be made of S42C and include a narrow diameter portion 15, a flange 16 having a large diameter, and a cylindrical portion 17 coaxially and integrally, and a tip 18 of the cylindrical portion 17 may be chamfered in preparation for a process. The tip 18 may be chamfered by another type of a rolling die (not shown in the figure) or a cold forging process. Alternatively, this chamfering process may be omitted.

Figure 5:
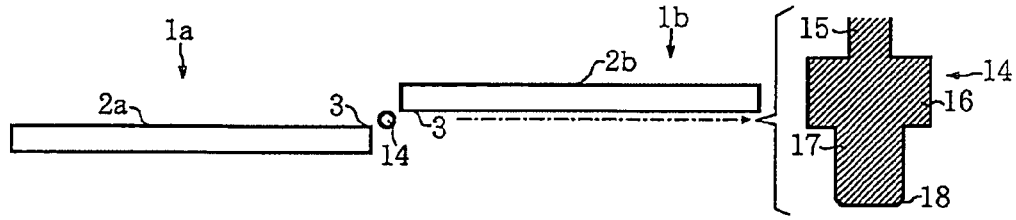
FIGS. 5-9 are plane views of the rolling die of FIG. 1 and cross-sectional views of a rod.
Figure 6:
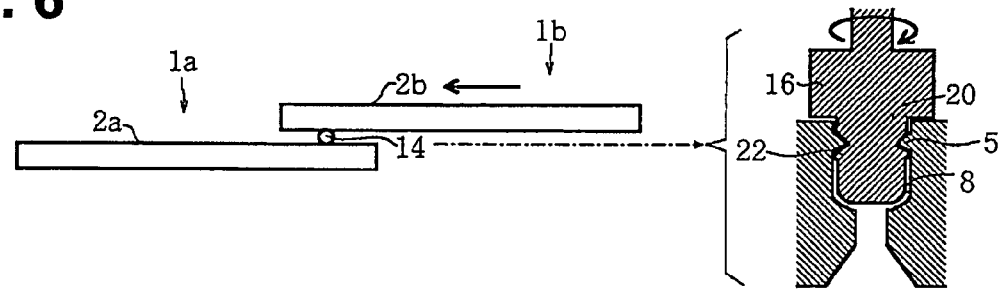

As shown in FIG. 5, the rod member 14 is vertically placed between the flat portions 3 of the process surfaces 2*a* and 2*b* of the die members 1*a* and 1*b* disposed in parallel along the longitudinal direction. Next, by the above mentioned slide mechanism, the die member 1*a* is moved closer to the die member 1*b*, and the rod member 14 is pressed and rolled between the symmetrically aligned start forming portions S1 of the process surfaces 2*a* and 2*b* as shown in FIG. 6. As a result, the pair of process teeth 5 symmetrically bite into the middle of the cylindrical portion 17 of the rod member 14 as shown in FIGS. 4(*b*) and 6, and a V-shaped cross-sectional groove 20 and a ring-shaped excess portion 22 proximate the groove are formed. A lubricant, such as cutting oil or water-soluble cutting oil, may be provided between the rod member 14 and the process surfaces 2*a* and 2*b*.

Figure 7:
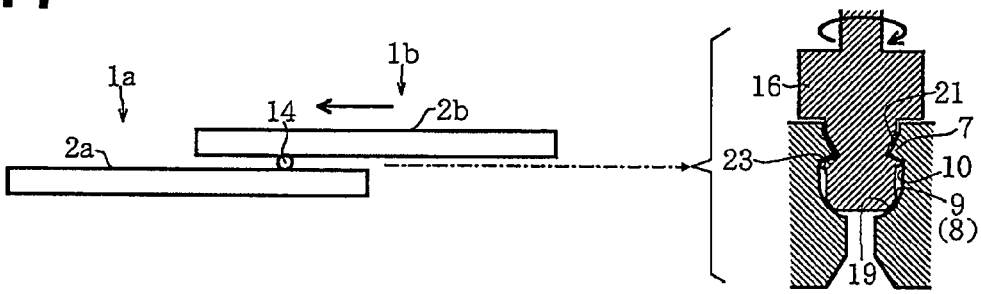

As shown in FIG. 7, furthermore, when the rod member 14 is pressed and rolled between the start forming portions S1, the groove 20 becomes a groove 21 having a wider width, and the excess portion 22 becomes a wider excess portion 23, as shown in FIGS. 4(*c*) and 7. The rod member 14 is rolled and moved along the radial direction to the intermediate forming portions S2 of the process surface 2*a* and 2*b*. As a result, the wider excess portion 23 contacts the small groove 10 and the curved surface 9, and at the chamfered portion 18 at the tip is pressed between the curved surfaces 9 into an arced surface 19. During this process, the rod member 14 is subjected to friction caused by the dimples G disposed from the start forming portion S1 to the intermediate forming portion S2 as shown in FIGS. 1 and 2, and the rod member 14 is formed into a desired shape.

Figure 8:
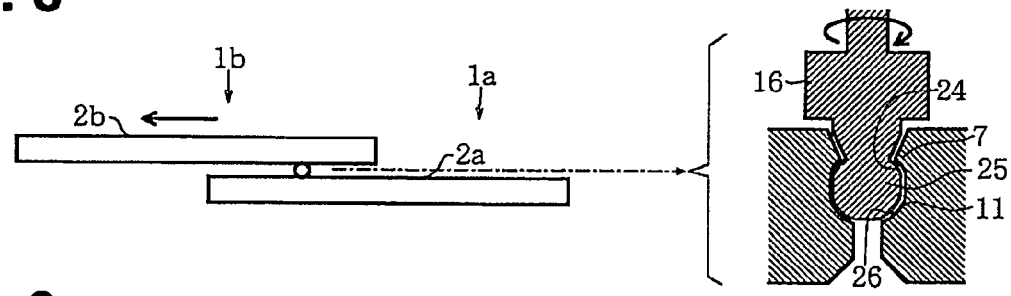

As illustrated in FIG. 8, the rod member 14 is rolled and moved from the intermediate forming portions S2 to the finish forming portions S3. As a result, by the process teeth 7 and the hemispheric grooves 11 shown in FIG. 4(D), a ball portion 25 is formed between almost hemispherical arced surfaces 24 and 26 as shown in FIGS. 4(*d*) and 8. At this time, the excess portion 23 is pressed by the hemispherical grooves 11 and moved to the arced surface 24 in the axial direction, and at the same time, a portion of the excess portion 23 is moved in the radial direction of the rod member 14. As illustrated in FIG. 8, the rod member 14 having the ball portion 25 is rolled between the finish forming portions S3 of the die members 1*a* and 1*b*.

As a result, by the hemispheric grooves 11 shown in FIG. 4(E), a rod part 29 having an almost spherical ball portion 28 with a tapered portion 27 is formed at one end by a rolling process as shown in FIGS. 4(*e*) and 9. The surface of the ball portion 28 is formed with contiguous curved surfaces in the axial direction, and a flat or dented portion may be provided near the center at the tip, and the ball portion 28 may be suitable for a ball joint.

As an example, a rod member made of the above described material and with 9 mm in diameter and 11 mm in length was processed by the rolling die 1, and the ball portion 28 with 10 mm in diameter was formed at one end. By using the rolling die 1 having the die members 1*a* and 1*b*, one rod member with such a ball portion was formed approximately in 2-3 seconds, and multiple rod members were continuously formed.

Therefore, by employing the rolling die 1 having the die members 1*a* and 1*b*, the rod part 29 with the ball joint 28 can be formed faster and more accurately than the conventional cutting and grinding process, and multiple rod parts can be continuously made cost effectively. Also, when rod members 14 are continuously formed into rod part 29 by the rolling die 1 with the die members 1*a* and 1*b*, the machine durability was more than twice as long when compared to a rolling die that forms the arc surface 26 of the ball portion 25 at a head portion and then cuts and removes the head portion by a cutter.

Figure 9:
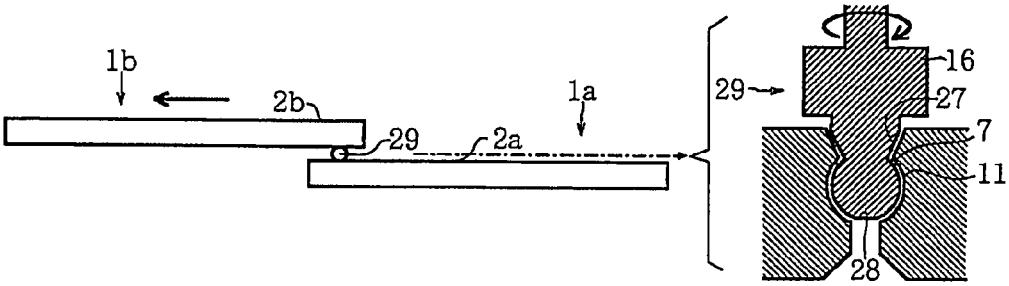
Figure 10:
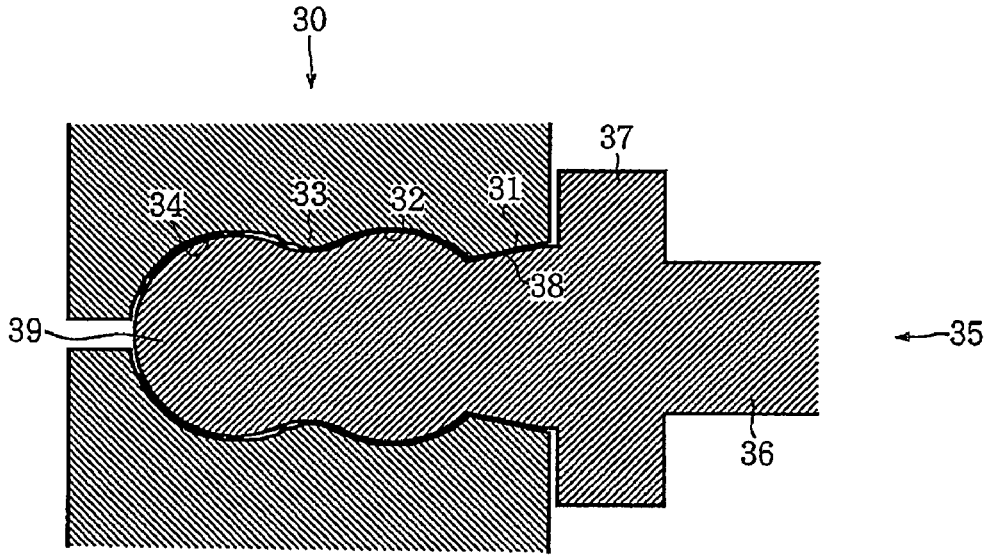
FIG. 10 is a cross-sectional view of the rolling die according to the second embodiment.

FIG. 10 illustrates a rolling die according to another embodiment of the invention and a rod part 35 just before the completion of the rolling process by the rolling die. As shown in FIG. 10, each of a pair of die members 30 has a sloped surface 31, an arced and concave surface 32, and an arced convex surface 33, and almost hemispherical surface 34 at the finish forming portion S3 of the process surface. The cylindrical portion of the rod member initially having a narrow diameter portion 36 and a flange 37 is continuously deformed by pressing with the process surface of the rolling die 30 and then, as shown in FIG. 9, a ball portion 39 having an hour-glass cross-sectional shape is formed by a rolling process.

Figure 11:
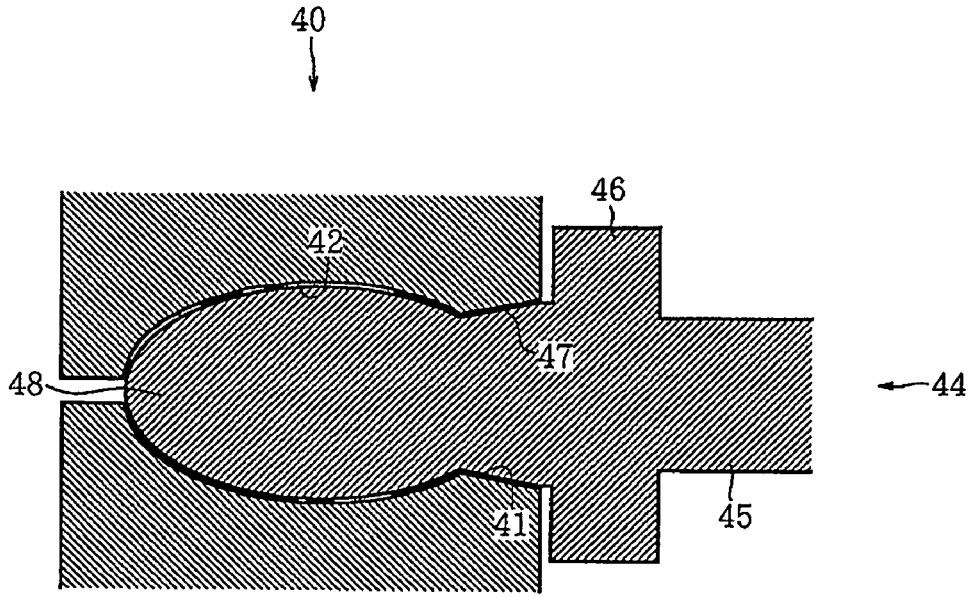
FIG. 11 is a cross-sectional view of the rolling die according to the third embodiment.
Figure 12:
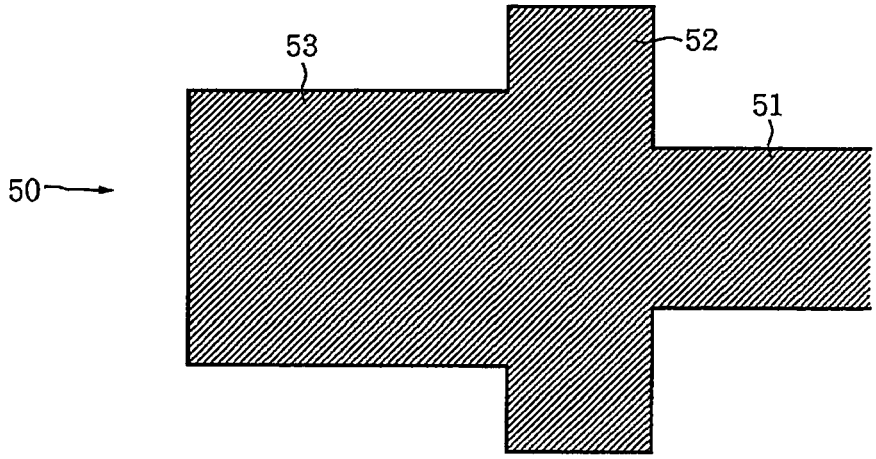
FIGS. 12-14 illustrate a conventional method of processing a rod.
Figure 13:
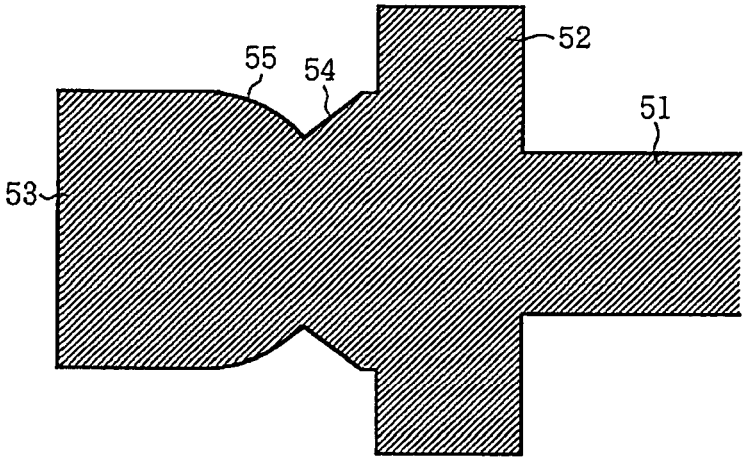
Figure 14:
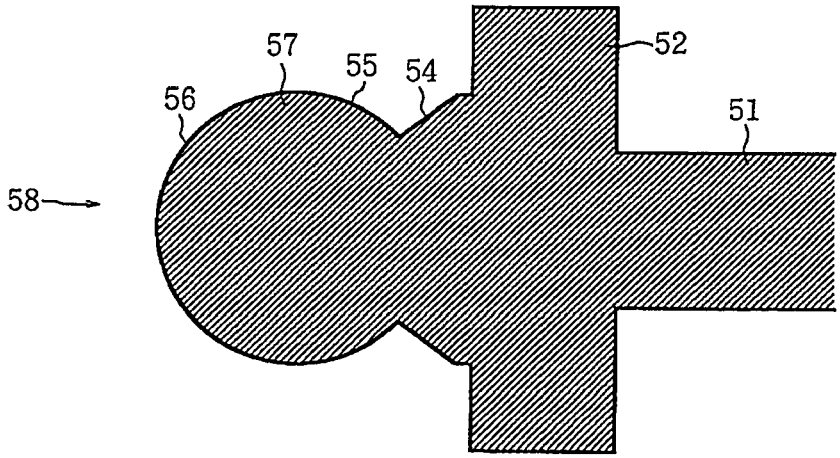

Also, FIG. 11 shows a rolling die according to another embodiment of the invention and a rod part 44 just before the completion of the rolling process by the rolling die. As shown in FIG. 11, each of a pair of die members 40 has a sloped surface 47 and a curved surface 42 having a half oval shaped cross-section proximate to the sloped surface at the finish forming portion S3 of the process surface. The cylindrical portion of the rod member initially having a narrow diameter portion 45 and a flange 46 is continuously deformed by pressing with the process surface of the rolling die 40 and then, as shown in FIG. 11, a ball portion 39 having an almost oval and spindle cross-sectional shape is formed by a rolling process. The rolling dies 30 and 40 can be formed by modifying the die members 1*a* and 1*b* of the rolling die 1.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims. For example, the ball portion can be formed not only at one end of the rod member but also at both ends or in the middle portion of the rod member. In addition to the ball portions illustrated in FIGS. 10 and 11, a ball portion may be in an elliptical cross-sectional shape having a major axis in the radial direction. Moreover, a portion proximate to the ball portion of the rod part may not be limited to a tapered portion and can be a cylindrical portion. Furthermore, a pair of the die members 1*a* and 1*b* may be disposed horizontally, vertically, or even diagonally. In addition, the rod member may be made of steel, stainless steel, or titanium alloy.

What is claimed is:

1. A rolling die for forming a rod member having a ball portion, comprising:

a first die member; and a second die member facing the first die member, each of the first die member and the second die member having a process surface, the process surface having:

a start forming portion having a process tooth configured to bite a rod member and an arc surface portion proximate the process tooth, the process tooth in the start forming portion having an inverse V-shaped cross-section for biting into the rod member and producing an excess portion in the rod member;

an intermediate forming portion having the process tooth and a curved surface proximate the process tooth, the curved surfaced being configured to press the rod member to form an arched shape; and a finish forming portion having the process tooth and a hemispheric groove configured to press the rod member into the arched shape to form the ball portion, the hemispheric groove being configured to move the excess portion in axial and radial directions of the rod member, and wherein a height and a width of the process tooth in the start forming portion increase towards the intermediate forming portion.

2. The rolling die of claim 1, wherein the process tooth, the arc surface, and the curved surface are formed with dimples.

3. A method of making a rod member with a ball portion, the rod member having a cylindrical portion, comprising:

placing the cylindrical portion of the rod member between a first process surface of a first die member and a second process surface of a second die member, each of the first and second process surfaces including a start forming portion having a process tooth with an inverse V-shaped cross-section, an intermediate forming portion, and a finish forming portion having a hemispheric groove, wherein a height and a width of the process tooth in the start forming portion increase towards the intermediate forming portion;

biting into the cylindrical portion with the process tooth of the start forming portion and producing an excess portion at the cylindrical portion:

rolling the cylindrical portion between the first process surface and the second process surface;

pressing the excess portion of the cylindrical portion in axial and radial directions thereof by the hemispheric groove formed on each of the first process surface and the second process surface; and forming the ball portion at an end of the rod member as the rod member is moved in a longitudinal direction of the first and second die members.

* * * * *